US005881590A

United States Patent [19]

Small

[11] Patent Number: 5,881,590

[45] Date of Patent: Mar. 16, 1999

[54] AXIAL DOOR BOLT RETAINER

[75] Inventor: Steven D. Small, San Rafael, Calif.

[73] Assignee: Schlage Lock Company, San Francisco, Calif.

[21] Appl. No.: 754,612

[22] Filed: Nov. 20, 1996

[51] Int. Cl.[6] ..... E05B 9/08

[52] U.S. Cl. ..... 70/451; 70/370; 70/DIG. 60

[58] Field of Search ..... 70/DIG. 60, 417, 70/224, 450, 452, 451, 370; 411/508, 913

[56] References Cited

U.S. PATENT DOCUMENTS

| | | | |
|---|---|---|---|
| 470,412 | 3/1892 | Roche | 70/452 |
| 1,875,396 | 9/1932 | Schlage | 70/370 |
| 2,207,898 | 7/1940 | Schlage | 70/370 |
| 3,500,670 | 3/1970 | Hawkins | 70/417 |
| 3,514,983 | 6/1970 | Krook et al. | 70/370 |
| 3,869,890 | 3/1975 | Neary | 70/DIG. 60 |
| 4,073,172 | 2/1978 | Schlage | 70/417 |
| 5,010,749 | 4/1991 | Lin | 70/224 |
| 5,186,030 | 2/1993 | Lin | 70/224 |
| 5,216,910 | 6/1993 | Lin | 70/417 |
| 5,267,461 | 12/1993 | Eizen | 70/417 |
| 5,551,264 | 9/1996 | Fann et al. | 70/DIG. 60 |

FOREIGN PATENT DOCUMENTS

| | | | |
|---|---|---|---|
| 469764 | 7/1974 | Australia | 70/451 |

*Primary Examiner*—Darnell M. Boucher
*Attorney, Agent, or Firm*—Michael H. Minns; Robert F. Palermo

[57] ABSTRACT

The several unassembled parts of a door lock assembly, nested axially within one another, are secured by axial retainer means which engage an aperture in the door lock assembly that is not used to secure inner and outer door lock assemblies to one another.

5 Claims, 6 Drawing Sheets

AXIAL DOOR BOLT RETAINER

FIELD OF THE INVENTION

This invention relates to door lock assemblies; more particularly, the invention relates to a door lock assembly in which parts of the door lock assembly, which are ultimately positioned on the outside of a door, are comprised of multiple parts, axially nested together.

BACKGROUND AND OBJECTS OF THE INVENTION

Typical door lock assemblies comprise groups of parts which are fitted to both the inside and the outside of a door. Typically, the outside assembly, that is, the assembly placed on the outside of a door, comprises multiple, axially arranged, parts for ease of assembly by an installer and to provide certain desired anti-vandalism features. Thus, a typical outside assembly might comprise first, a lock cylinder housing assembly, secondly a brass, shrouding the lock cylinder assembly ring into the inner periphery of which is placed a third part, namely a so-called ring insert. These parts are manufactured in separate pieces and are assembled on-site by nesting them axially along the axis of the bore hole found in a door.

For increasing the attractiveness of the lock, particularly the outer assembly thereof, it is also typical to finish the outside assembly in a bright and attractive finish.

However, because the door locks are manufactured, and assembled in the field from multiple pieces, it often happens that an installer (even if he is experienced) may drop one or more of the parts, thereby damaging the attractive exterior polish of the outside assembly, and thus lead to consumer dissatisfaction if the outside assembly is not replaced.

Thus, it a primary object of the invention to provide means whereby the multiple parts of a door lock assembly may be secured axially, that is, along their axis of assembly, against axial movement with respect to one another.

SUMMARY OF THE INVENTION

According to one aspect of the invention, a multiple part door lock assembly (whether inside or outside) is secured against inadvertent axial movement of the multiple parts thereof by a retainer. Depending upon the precise configuration of the inwardly facing surfaces of the respective door lock inner and outer assemblies, the axial retainer engage at least one aperture provided on the interior parts of the respective inner, or outer, door lock assemblies. The retainer may be "plugged" into one of the apertures to form, by way of an interference fit, and peripheral restraint means, an axial retainer.

For those door lock assemblies which have no empty apertures in which to receive by friction fit an axial retainer, such may be provided by a rotationally restricted plate fastened to the door lock assembly by means, for example, of a threaded screw, already present in the door lock assembly to restrain axial movement of the lock cylinder with respect to the housing in which it is placed.

These, and other objects, aspects, features, and advantages of the invention will become apparent in the following detailed description accompanied by the drawings thereof.

DETAILED DESCRIPTION

Figure 1A:
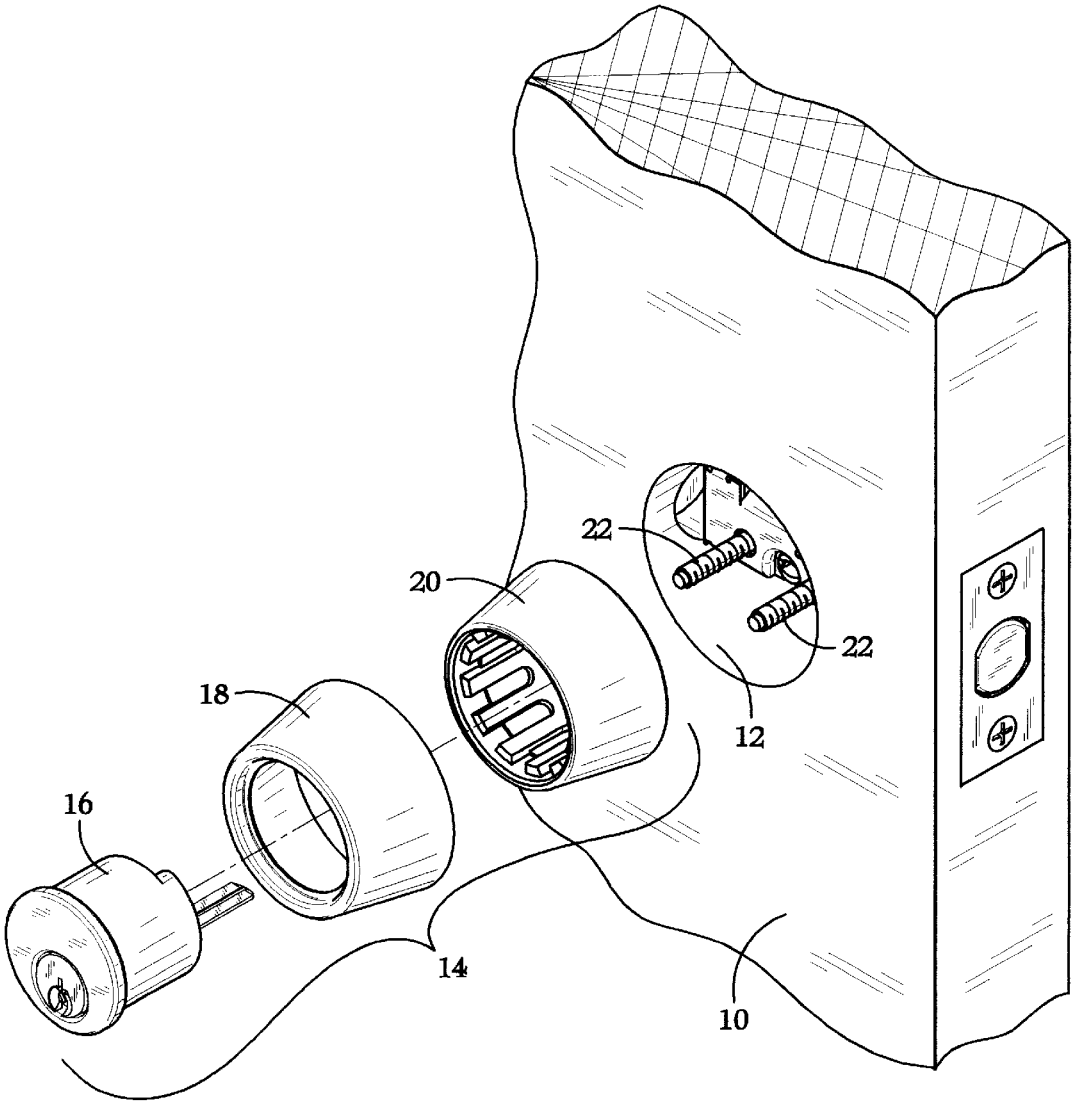
FIG. 1A shows an external, exploded, view of a typical outside door lock assembly.

With reference to FIG. 1A, there is shown a typical door frame 10 having a bore hole 12 adapted to receive a typical outer door lock assembly 14. Outer door lock assembly 14 comprises a cylinder and housing assembly 16, a ring 18 (typically made of a brass finish) and a ring insert 20.

The parts 16, 18, and 20 are designed for axial nesting, one within the other, along the axis of the bore 12. Parts 16, 18 and 20 are separately manufactured items to be assembled on-site with the installation of a door lock assembly in a door.

Mounting screws 22 are provided to secure assembly 14 to the outside of door 10 when the installation is completed.

As noted above, the separate parts 16, 18, and 20 may be dropped during installation so that the exterior finish of at least one of the parts may be damaged, and the structural shape of several of them may be altered, rendering them unfit for use.

Figure 1B:
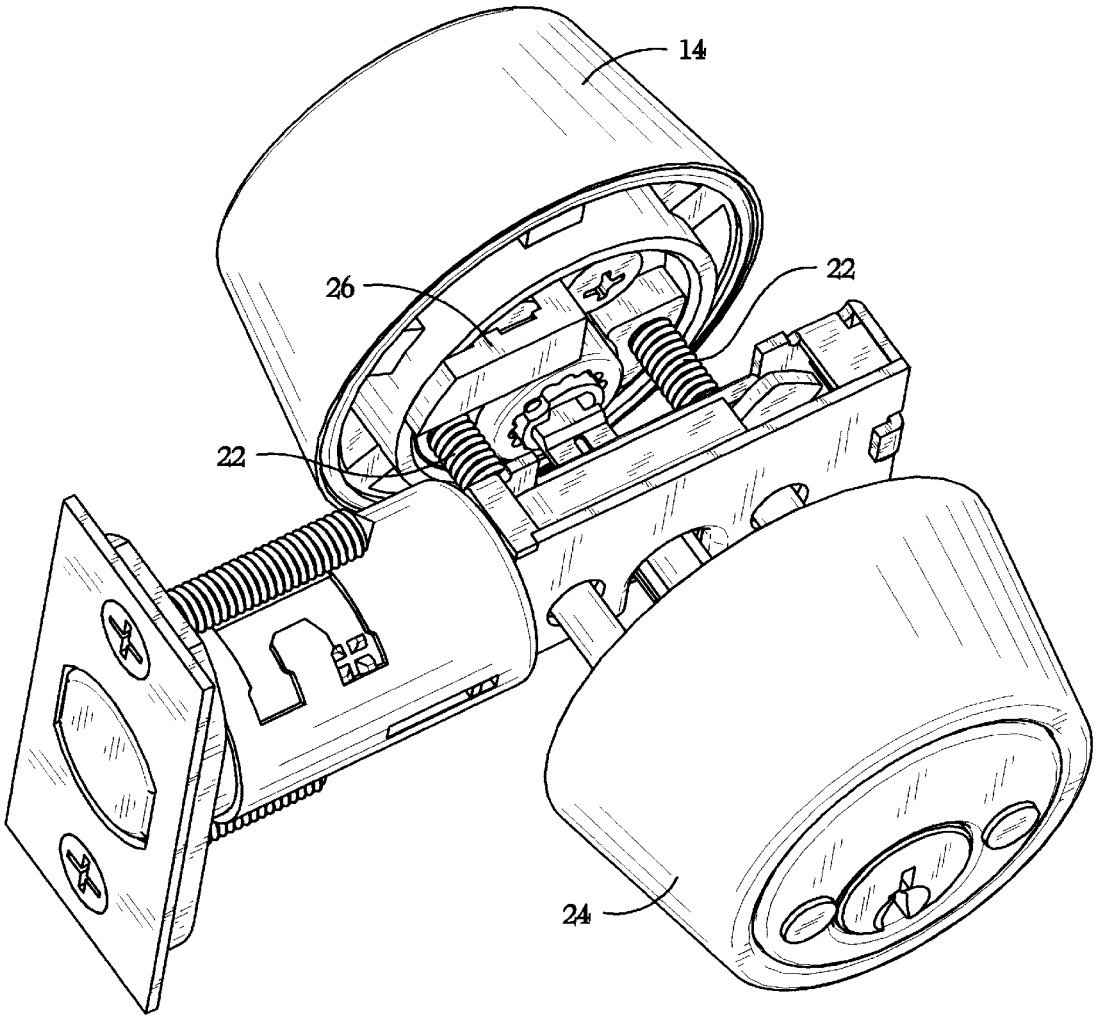
FIG. 1B shows an assembly, view of the internal side of an outdoor door lock assembly and also showing one preferred version of the axial retainer in accordance with the invention.

With reference to FIG. 1B, it shows a view of the interior face of the outer door assembly 14, together with an inner door assembly 24 and the axial restraining means 26 of the invention in its assembled position. Mounting screws 22 secure the outer assembly 14 with the inner assembly 24 once the door lock assembly has been installed.

Figure 2:
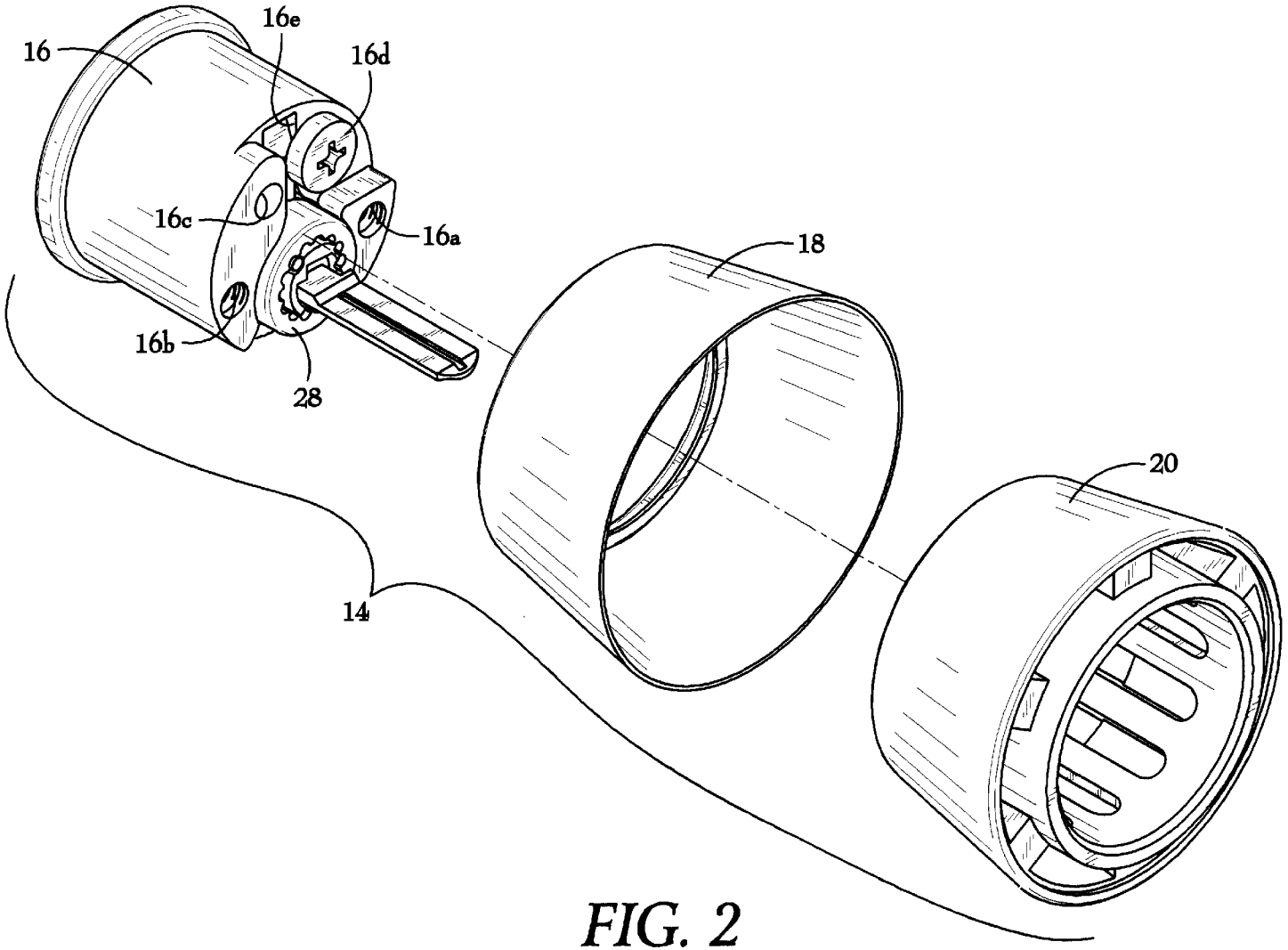
FIG. 2 shows an exploded, perspective, internal view of the multiple parts of a typical outside door lock assembly.

With reference now to FIG. 2, there is shown an exploded perspective view showing the interior face of the outer door lock assembly 14. More particularly, cylinder and housing assembly 16 exhibits on its interior face, apertures 16*a*, 16*b*, and 16*c*. Apertures 16*a* and 16*b* are preferably threaded to receive mounting screws 22 (see FIG. 1A) so that the outer door lock assembly 14 may be secured to the door.

Cylinder and housing assembly 16 also has, on its interior side, an aperture 16*c* which may, or may not, be threaded. The purpose of aperture 16*c* will become apparent from the ensuing description. Cylinder and housing assembly 16, when assembled, will also have as part thereof a screw 16*d*, the purpose of which is to axially restrain the lock cylinder, shown partially as 28.

Figure 3:
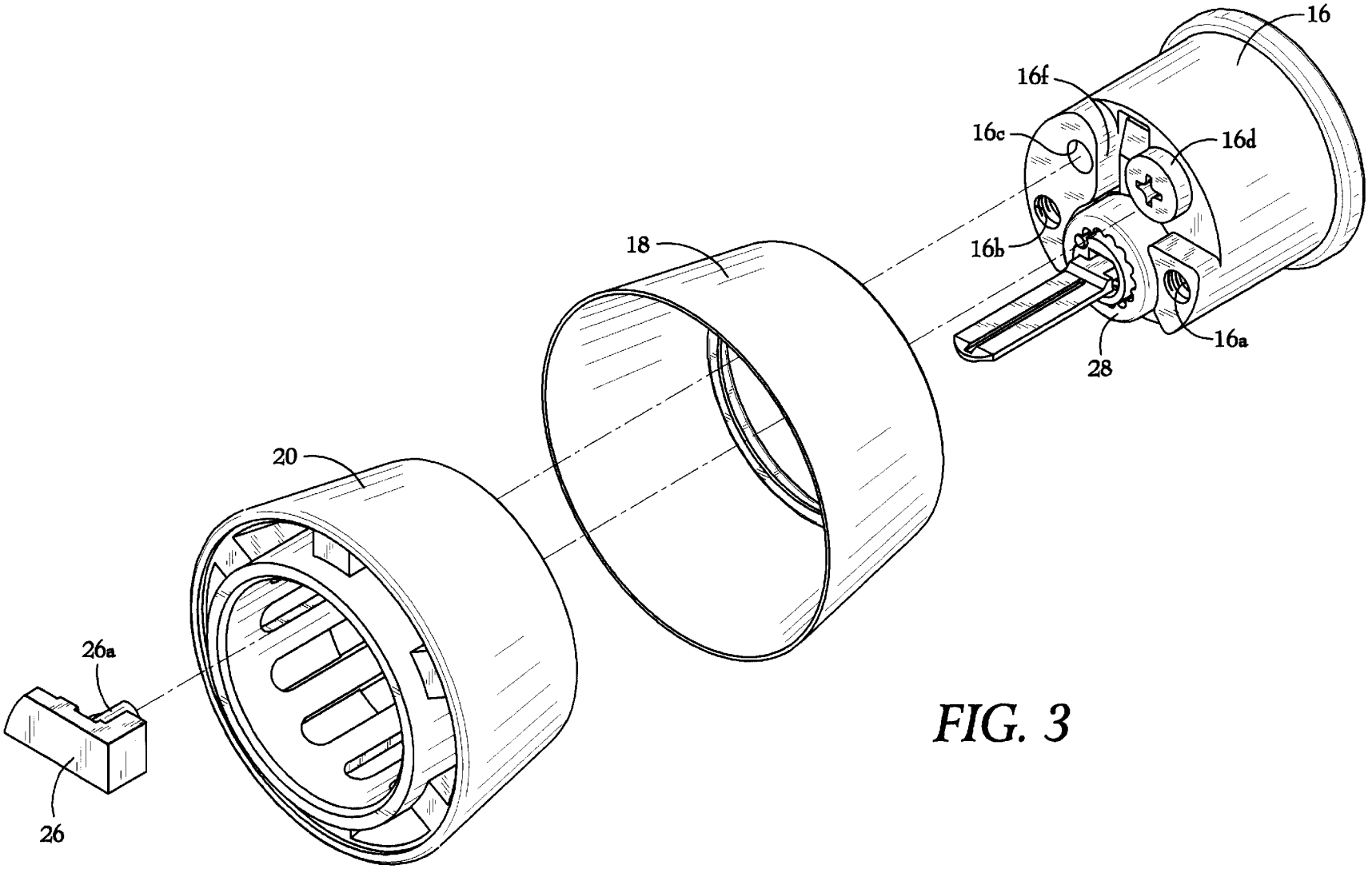
FIG. 3 shows an exploded, partial perspective, interior view of the multiple parts of a typical outside door assembly together with one of the preferred embodiments of the invention for an axial retainer means.

With reference to FIG. 3, it shows an exploded, pre-assembled, view of the various parts previously described with reference to FIGS. 1 and 2. More particularly, FIG. 3 shows that the axial retainer 26 has a pin projection 26*a* designed to be pressed-fitted into aperture 16*c* when the outer door lock assembly 14 has been collapsed onto itself.

Retainer 26 also has a downwardly depending portion 26*f* to engage a tail 16*f* of the cylinder and housing assembly 16 to prevent rotation of retainer 26.

Figure 4:
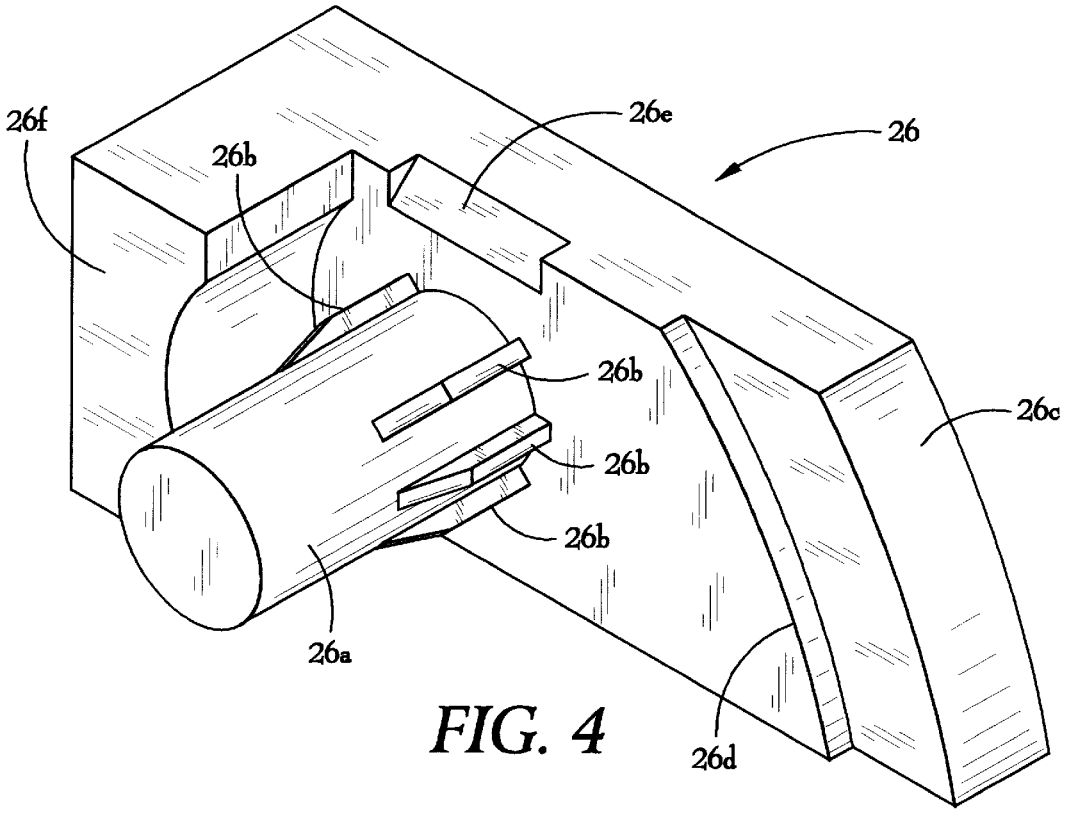
FIG. 4 shows a perspective view of the axial restraining means in accordance with one preferred embodiment of the invention.

With reference to FIG. 4, axial retainer 26 shows a pin projection 26*a* having on the periphery thereof protrusions 26*b* which are, designed to perform a friction fit when axial restrainer 26 is inserted into aperture 16*c* (see FIG. 3).

The retainer 26 has a peripheral outer edge which is stepped, in which the outer most peripheral edge 26*c* is stepped from the interior edge 26*d*. Retainer 26 also has a beveled cutout 26e so that, the retainer 26 may be removed after it has been inserted into aperture 16*c*. Beveled edge 26*e* facilitates the insertion of, for example, a screwdriver, to free the retainer 26 from its inserted position.

Figure 5A:
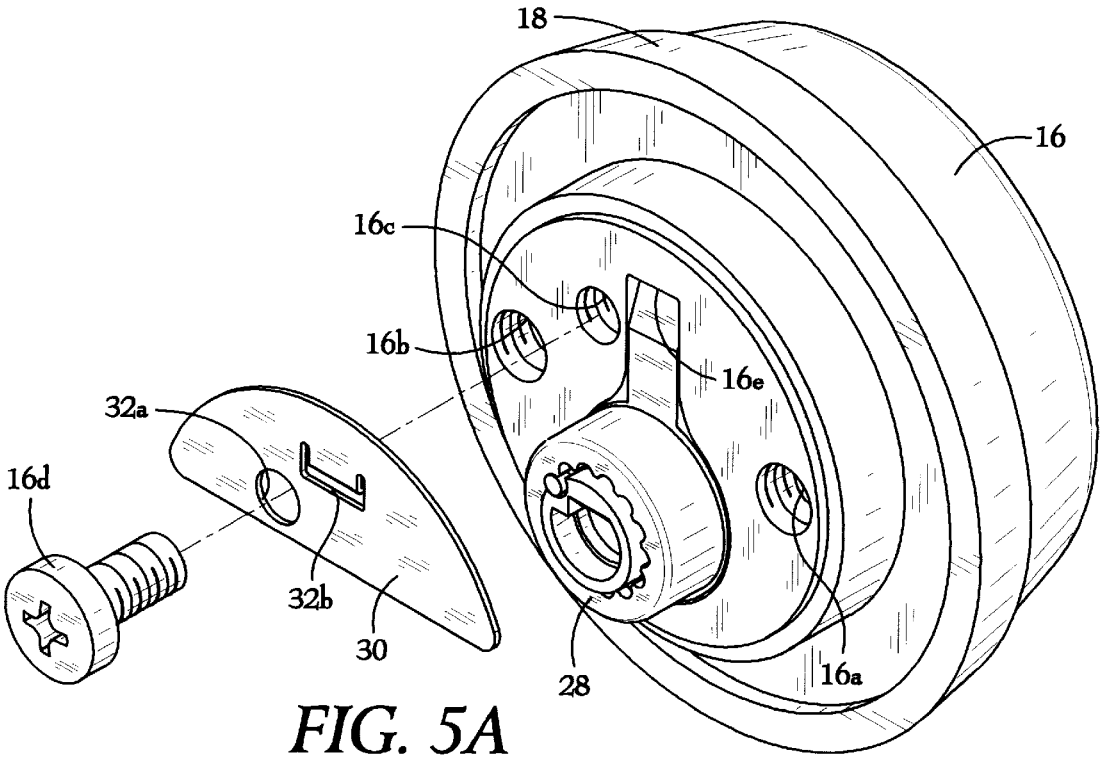
FIG. 5A and 5B show, respectively, an exploded unassembled view of axial retainer in accordance with a second embodiment of the invention, and when it has been assembled.
Figure 5B:
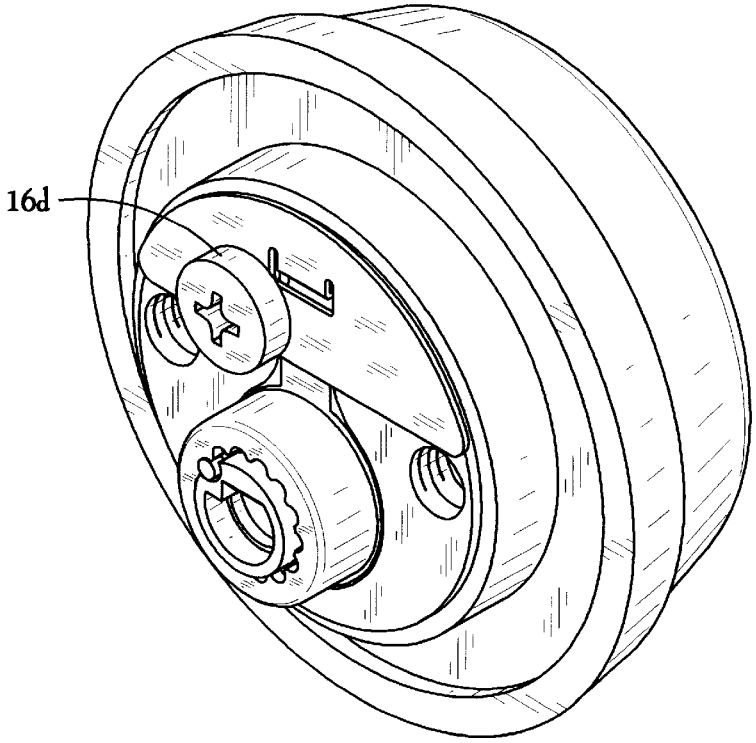

With reference to FIGS. 5A and 5B, there is shown an alternate preferred embodiment of the invention in which the cylinder and housing assembly 16 has only one vacant bore 16*c* (in additions to bores 16*a* and 16*b* for receiving the mounting screws 22). In such an embodiment, aperture 16*c* receives the screw 16*d* and its normal function, absent the invention, is to secure the lock cylinder 28 against axial movement. In addition, an housing assembly 16 also exhibits a cutout 16*e* the function of which will be described shortly.

In accordance with an alternate embodiment of the invention, a retainer plate 30 is interposed between bolt 16*d* and aperture 16*c*. Plate 30 has an aperture 32*a*through which bolt 16*d* will pass prior to being secured. Plate 30 also has a cutout 32*b* with a ledge 32*c* (see FIG. 6) designed to fit into aperture 16*e* of the cylinder and housing assembly 16. Tab, or ledge, 32*c*, when fitted into aperture 16*e* will prevent plate 30 from rotation about the axis of aperture 16*c*. Thus, the screw 16*d*, in addition to serving its normal function of axially restraining the cylinder lock also serves to axially secure the cylinder and lock assembly 16 through the ring 18 by way of retainer plate 30.

Figure 6:
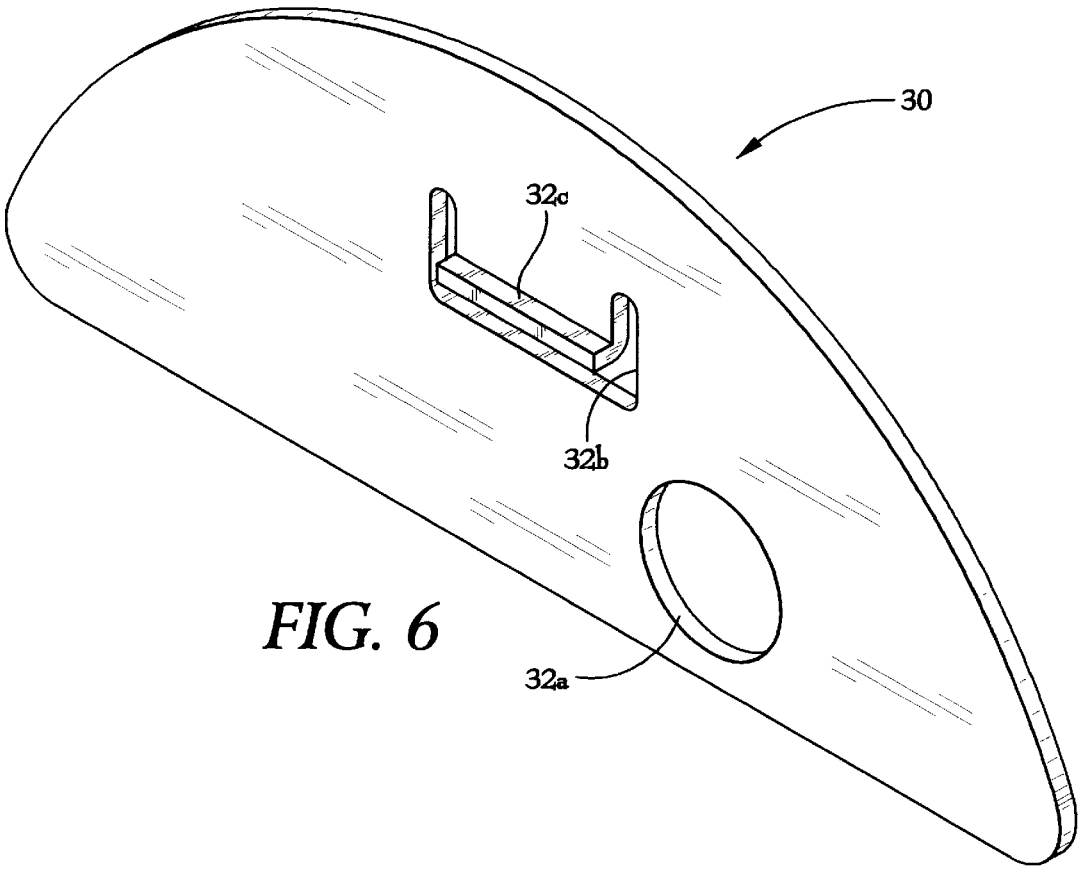
FIG. 6 shows a perspective view of an axial retainer, in accordance with a second embodiment of the invention, from the outwardly facing side.

As shown in greater detail of FIG. 6, the tab 32*c* fits into aperture 16*e* prevent it from rotation about the axis of aperture 16*c*.

Retainer 26 and plate 30 may be made of any suitable material, including metals, plastics, or the like.

While the invention has now been illustrated with a door lock assembly that is placed on the outside of a door, it can equally well be used when the inside door assembly also has cylinder lock assembly—that is, when the entire door lock assembly is a double cylinder assembly.

While the invention has been described with reference to two preferred embodiments, it will become apparent that these have been used for illustrations only and that the invention is to be limited only by the claims attached thereto.

What is claimed is:

1. In a door lock assembly having a plurality of axially nested parts along an axis transverse to the plane of a door, the parts being separate prior to assembly, and having a periphery, an the interior face of the door lock assembly having at least one additional aperture in addition to two apertures used to assemble the door lock assembly, the improvement comprising:

a means for axially retaining the plurality of nested parts, the means comprising a monolithic retainer having: a radially extending first portion; a non-threaded circular pin for engaging the at least one aperture, the pin extending axially from the first portion; and an axially extending second portion for engaging one of the nested parts, the second portion being proximate the pin, the radially extending first portion extending away from both the circular pin and the axially extending portion.

2. The door lock assembly according to claim 1, wherein the pin extends axially further than the second portion.

3. In a door lock assembly having a plurality of axially nested parts along an axis transverse to the plane of a door, the parts being separate prior to assembly, and having a periphery, with an interior face of the door lock assembly having at least one additional aperture in addition to two apertures used to assemble the door lock assembly, the improvement comprising:

a means for axially retaining the plurality of nested parts, the means comprising a monolithic retainer having: a radially extending first portion; a non-threaded pin for engaging the at least one aperture, the pin extending axially from the first portion; and an axially extending second portion for engaging one of the nested parts, the second portion being proximate the pin, the first portion having a first side proximate the nested parts, the first side having a shoulder portion proximate an outer end of the first portion.

4. In a door lock assembly having a plurality of axially nested parts along an axis transverse to the plane of a door, the parts being separate prior to assembly, and having a periphery, with an interior face of the door lock assembly having at least one additional aperture in addition to two apertures used to assemble the door lock assembly, the improvement comprising:

a means for axially retaining the plurality of nested parts, the means comprising a flat semi-circular plate, the plate having a means for preventing rotation of the plate, the means comprising an aperture therethrough with a single bent tab extending axially therefrom, the tab engaging an aperture in one of the nested parts, and a connector attaching the plate to one of the nested parts.

5. The door lock assembly according to claim 4, wherein the connector is a screw.

* * * * *